US011697192B2

(12) United States Patent
Quicke

(10) Patent No.: US 11,697,192 B2
(45) Date of Patent: Jul. 11, 2023

(54) TOOL FOR USE IN PLACES WITH RESTRICTED ACCESS

(71) Applicant: Enerpac UK Ltd, Northumberland (GB)

(72) Inventor: Stephen Quicke, Northumberland (GB)

(73) Assignee: Enerpac UK Ltd, Northumberland (GB)

( * ) Notice: Subject to any disclaimer, the term of this patent is extended or adjusted under 35 U.S.C. 154(b) by 364 days.

(21) Appl. No.: 16/956,571

(22) PCT Filed: Dec. 21, 2018

(86) PCT No.: PCT/GB2018/053746

§ 371 (c)(1),
(2) Date: Jun. 20, 2020

(87) PCT Pub. No.: WO2019/122920

PCT Pub. Date: Jun. 27, 2019

(65) Prior Publication Data

US 2021/0031337 A1 Feb. 4, 2021

(30) Foreign Application Priority Data

Dec. 21, 2017 (GB) ..... 1721522

(51) Int. Cl.
*B25B 13/48* (2006.01)
*B25B 21/00* (2006.01)
(Continued)

(52) U.S. Cl.
CPC ..... *B25B 13/481* (2013.01); *B25B 21/005* (2013.01); *B25B 21/007* (2013.01); *B25B 23/0078* (2013.01); *B25F 5/025* (2013.01)

(58) Field of Classification Search
CPC ..... B25B 13/48; B25B 13/481; B25B 21/00; B25B 21/005; B25B 21/007; B25B 23/00; B25B 23/0078; B25F 5/02; B25F 5/025
See application file for complete search history.

(56) References Cited

U.S. PATENT DOCUMENTS 2,882,773 A * 4/1959 Wing ..... B25B 21/002 81/475
2001/0039858 A1* 11/2001 Junkers ..... B25B 23/0078 81/57.39

(Continued)

FOREIGN PATENT DOCUMENTS

EP 1329293 A2 7/2003
EP 2055435 A2 5/2009

(Continued)

OTHER PUBLICATIONS

Communication received from the European Patent Office for related Application No. 18839853.1 dated May 10, 2022 (7 Pages).

(Continued)

*Primary Examiner* — Robert J Scruggs
(74) *Attorney, Agent, or Firm* — Andrus Intellectual Property Law, LLP

(57) ABSTRACT

A reaction arm mounting assembly comprises a first part and a second part, the first part being configured for attachment to a power tool and the second part is mounted on the first part. The mounting of the second part on the first part: permits sliding motion between the first and second part along an axis common to the first and second parts in a first sliding region and prevents rotation between the first and second member in the first sliding region; and permits rotation between the first and second members in a second sliding region.

26 Claims, 11 Drawing Sheets

(51) Int. Cl.
*B25B 23/00* (2006.01)
*B25F 5/02* (2006.01)

(56) References Cited

U.S. PATENT DOCUMENTS

| | | | | |
|---|---|---|---|---|
| 2010/0269645 | A1* | 10/2010 | Bonas | B25B 21/005 81/462 |
| 2010/0270048 | A1 | 10/2010 | Junkers | |
| 2016/0067849 | A1* | 3/2016 | Junkers | B25B 13/481 81/57.3 |
| 2016/0375563 | A1 | 12/2016 | Junkers et al. | |

FOREIGN PATENT DOCUMENTS

| | | | |
|---|---|---|---|
| WO | 2012114361 | A1 | 8/2012 |
| WO | 2017031519 | A1 | 3/2017 |

OTHER PUBLICATIONS

International Search Report and Written Opinion for Application No. PCT/GB2018/053746 dated Apr. 23, 2019 (9 pages).
International Preliminary Report on Patentability for Application No. PCT/GB2018/053746 dated Jun. 23, 2020 (6 pages).
Brazilian Patent Office Action for Related Application No. BR112020012730-2 dated Sep. 7, 2022 (5 pages, Including an English statement of relevance with a brief summary of the office action).

* cited by examiner

SECTION B-B
SCALE 1 : 1.5

SECTION A-A
SCALE 1 : 1.5

TOOL FOR USE IN PLACES WITH RESTRICTED ACCESS

FIELD OF THE INVENTION

The present invention relates to a tool for tightening and loosening fasteners of the type that include a reaction arm, and in particular to such a tool for use in places with restricted access.

BACKGROUND OF THE INVENTION

Tools are widely used with tightening and loosening fasteners. It is not uncommon for fasteners to be situated within spaces to which access is restricted. Restricted access can make the action of tightening and loosening fasteners difficult, which may result in fasteners not being tightened or loosened correctly, the fastener or surrounding components being damaged or the operator using a tool being required to work in an uncomfortable and inefficient manner. Operators may be injured if a tool were to release from a fastener inadvertently.

One application where access is restricted is in the assembly of aircraft wing components. Where wing components are to be fastened together, access may be so restricted that it is necessary for an operator to climb into the wing in order to position and operate a tool.

Tools that utilise reaction arms can become locked onto the fastener that is being turned by the tool. When this happens removing the tool can be problematic.

Typically, it is not possible to re-position the reaction arm of the above-described type of tool without removing the whole tool from the fastener that is being turned.

It would therefore be desirable to provide a tool that is specifically adapted for use in places in which access is restricted.

It would also be desirable to provide a tool which stops tightening or loosening a fastener once a desired torque has been reached. In the case of aircraft in particular it is important that fasteners are not either over or under tightened.

SUMMARY OF THE INVENTION

According to a first aspect of the invention there is provided a reaction arm mounting assembly comprising a first part and a second part, wherein the first part is configured for attachment to a power tool and a second part is mounted on the first part, and wherein the mounting of the second part on the first part: permits sliding motion between the first and second part along an axis common to the first and second parts in a first sliding region and prevents rotation between the first and second member in the first sliding region; and permits rotation between the first and second members in a second sliding region.

Preferably, the first and second parts of the assembly include co-operating protrusions and indents respectively and wherein the first sliding region is provided by the co-operating protrusions and indents.

Preferably, in the second sliding region one of the first and second parts is free of indents or protrusions that co-operate with protrusions or indents of the other of the first and second member.

It is preferred that, the first part of the reaction arm mounting assembly is free of indents or protrusions in the second sliding region.

One of the first and second parts may be mounted about the other of the first and second parts.

The protrusions and indents may be provided by a plurality of co-operating splines on each of the first and second parts.

The reaction arm mounting assembly may comprise biasing means configured to exert a biasing force on the first and second parts, the biasing force urging the first and second parts biased such that they are situated in the first sliding region.

The assembly may include a biasing means support comprising first and second biasing means support components, wherein the first biasing means support component is attached to the first part and the second biasing means support component is attached to the second part.

A part of the first biasing means support may be surrounded by the biasing means.

The biasing means may be situated inwardly of the second biasing means support component.

Preferably, the first biasing means support comprises a biasing means enclosure member, which surrounds the biasing means and which is arranged to permit sliding and rotation relative to the second biasing means support.

Preferably, the second part forms a part of or is attachable to a reaction arm.

A second aspect of the invention provides a power tool having a reaction arm mounting assembly of the first aspect of the invention attached thereto.

The power tool may further comprise a reaction arm.

Preferably, the reaction arm includes two parts connected together by a lockable pivot assembly.

Preferably, the reaction arm mounts a socket head.

The reaction arm may be adapted for the removable attachment of a socket head.

The power tool may comprise a set of different socket heads.

According to a third aspect of the invention there is provided a power tool including a ratchet drive, the power tool comprising:

a ratchet driven socket mounted for rotation within a ratchet drive housing;

a fastener engagement member configured to resist rotation of a fastener engaged therewith;

a mount for the fastener engagement member, the ratchet drive socket, the fastener engagement member and the mount co-axial with each other, the fastener engagement member slidably mounted in the mount, wherein the shape and configuration of the mount and the fastener engagement member prevent relative rotation therebetween;

an opening in the ratchet drive housing, the mount slidably mounted in the opening, wherein the shape and configuration of the mount and the opening prevent relative rotation therebetween;

biasing means arranged to exert a force urging the fastener engagement member along the common axis in a direction away from the opening in the ratchet drive housing;

a motion restrictor associated with the mount and limiting the extent of sliding motion of said mount through the opening.

The motion restrictor may include a first element attached to the mount and at least one second element situated in the path of the mount.

One of the at least one second elements may comprise a collar mounted on the socket and including a portion extending into the path of the first element.

One of the at least one second elements may comprise part of the housing proximate the opening, the first element extending radially beyond the edge of the opening.

The power tool may further comprise a fastener support member including an inner peripheral edge, the fastener so shaped and dimensioned as to permit passage of a fastener therethrough and wherein in use, with a fastener extending through the fastener support member, the inner peripheral edge and an outer surface of the fastener engage with each other upon operation of the power tool.

The power tool may further comprise a cap member attached to the mount and situated to an outer side of the ratchet drive housing, wherein one end of the biasing means is housed in the cap and wherein the cap is provided with means to urge the cap towards the ratchet drive housing.

Preferably, the means to urge the cap towards the ratchet drive housing is a magnetic means.

The magnetic means may comprise a plurality of spaced apart magnets mounted in the cap.

Preferably, the power tool has attached thereto a reaction arm mounting assembly of the first aspect of the invention.

Preferably, the power tool further comprises a reaction arm.

Advantageously, the reaction arm includes two parts connected together by a lockable pivot assembly.

It is preferred that the reaction arm mounts a socket head.

Advantageously, the reaction arm is adapted for the removable attachment of a socket head.

Advantageously, a set of different socket heads is provided for attachment to the reaction arm.

BRIEF DESCRIPTION OF THE DRAWINGS

In the drawings, which illustrate preferred embodiments of the invention and are by way of example.

DETAILED DESCRIPTION OF THE PREFERRED EMBODIMENTS

Figure 1:
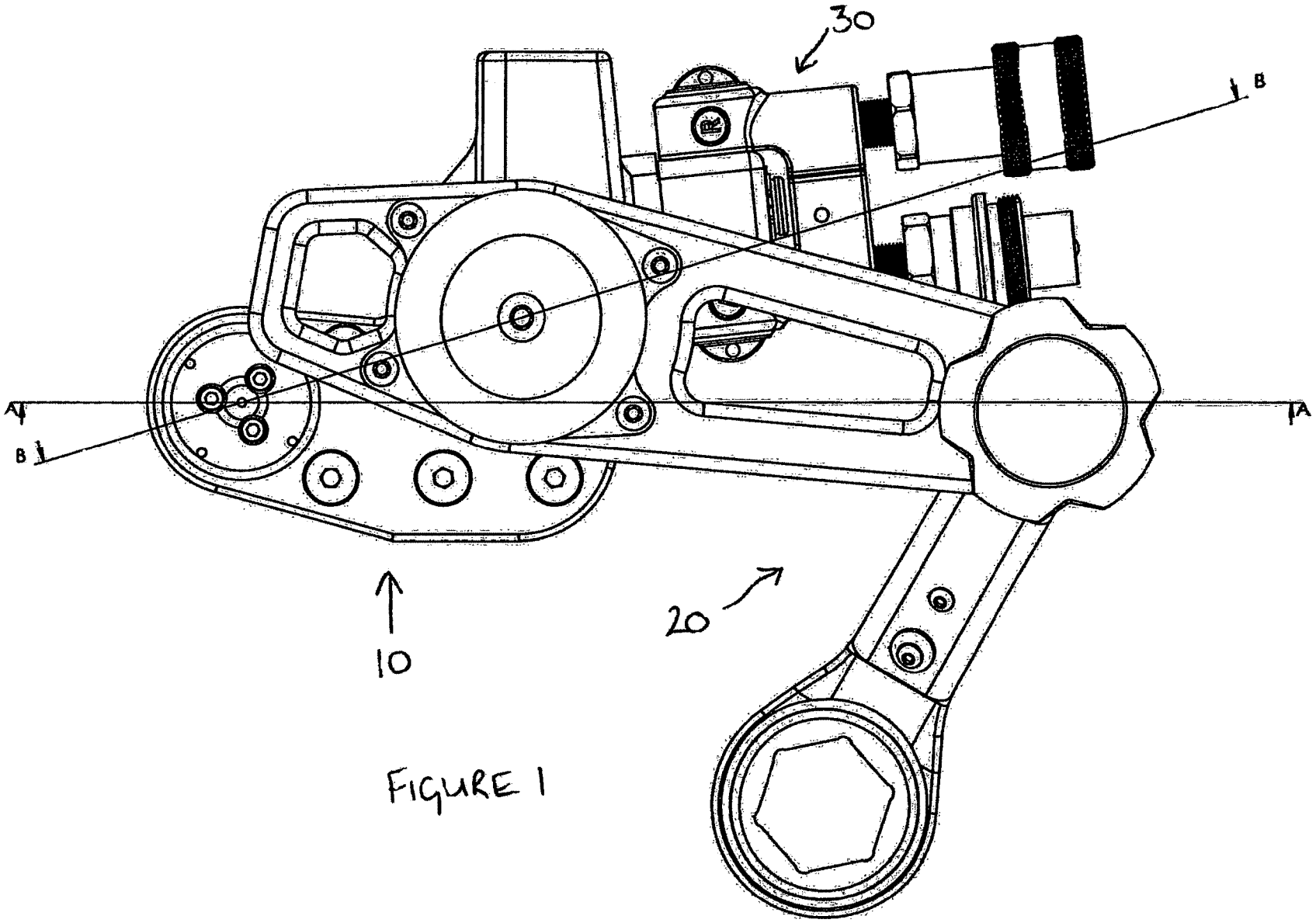
FIG. 1 is a plan view of a hydraulically actuated tool.

Referring now to FIG. 1, a hydraulically actuated tool 1 comprises a ratchet link 10, a reaction arm 20 and a power head 30.

The arrangement of the components of the tool 1 are illustrated in greater detail in 2*a* to 11.

The reaction arm 20 is mounted on the ratchet link 10 which comprises spaced apart side plates 11 and a cover plate 12 attached to one of the side plates 11. The cover plate 12 is attached to the side plate 11 by screws 12*b*. The cover plate 12 includes a plurality of holes 12*a* which provide for the attachment of a reaction arm mount 14.

The reaction arm mount 14 includes a collar 15 with a flange 15*a* which includes holes through which externally threaded screws 15*b* pass to engage with internally threaded holes 12*a*, thereby attaching the reaction arm 15 to the ratchet link 10.

Figure 5:
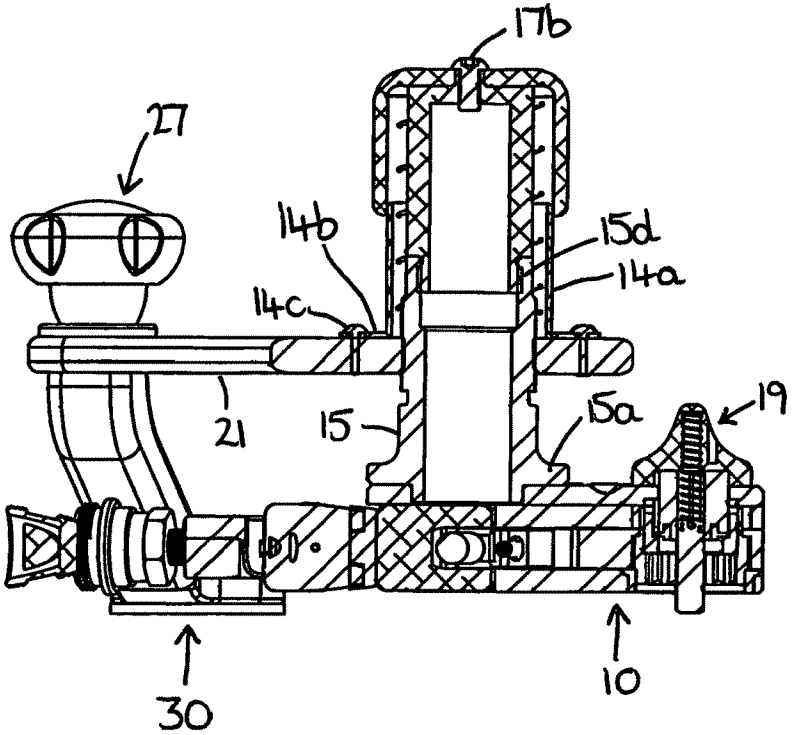
FIG. 5 is a cross-sectional elevation on the axis B-B indicated in FIG. 1.

The reaction arm mount 14 is shown in greater detail in FIG. 5. The collar 15 extends away from the flange 15*a* and terminates with an internally threaded end 15*d*. A sleeve 17 has an externally threaded end 17*a*, the threaded ends 15*d* and 17*a* configured such that the sleeve 17 attaches to the collar 15. The sleeve 17 is attached to a cap 14*d* by means of a screw 17*b*. A tube 14*a* is mounted to slide within the cap 14*d*. A flange 14*b* extends from one end of the tube 14*a* and is attached to a first lever 21 of the reaction arm 20 by externally threaded screws 14*c* which engage with internally threaded holes 21*b* formed in the lever 21.

A spring 14*e* is situated between the inner face of the cap 14*d* and the lever 21. The arrangement of the cap 14*d*, tube 14*a* and spring 14*e* allow the lever 21 to be moved up along the axis x-x against the spring 14*e*.

Figure 4:
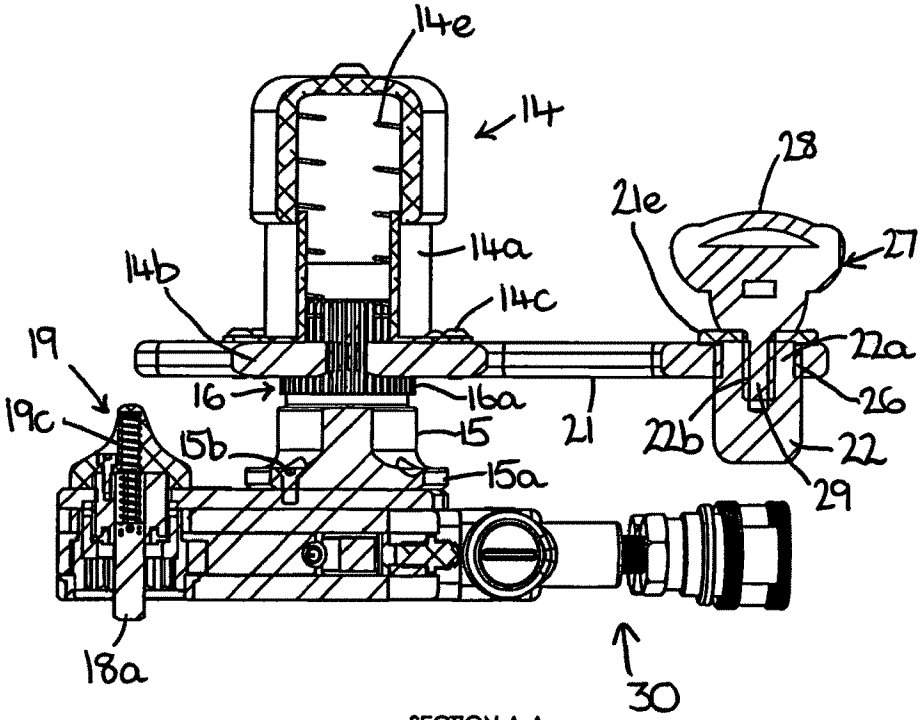
FIG. 4 is a cross-sectional elevation on the axis A-A indicated in FIG. 1.
Figure 6B:
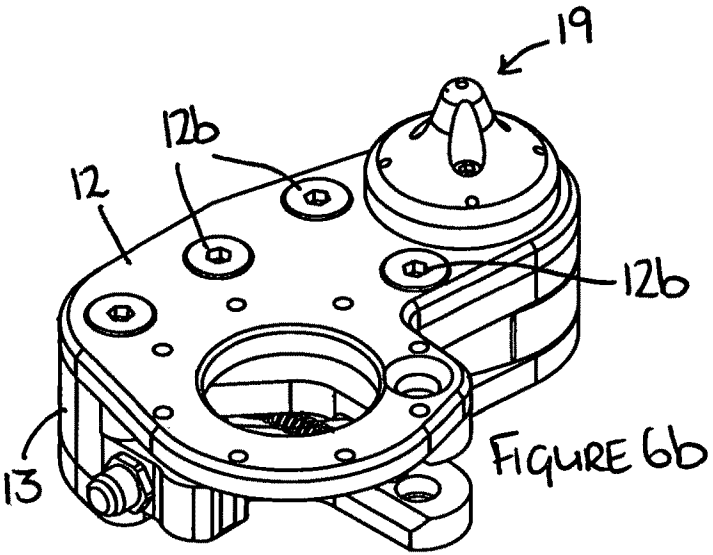
FIG. 6*b* is a schematic representation of the component illustrated in FIG. 6*a* view from above.
Figure 6D:
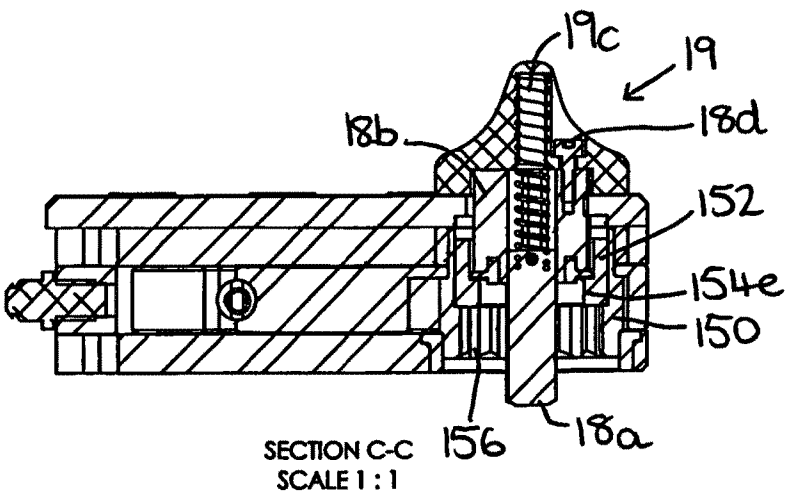
FIG. 6*d* is a cross-sectional elevation of the component on the axis C-C indicated in FIG. 6*c;*
Figure 6A:
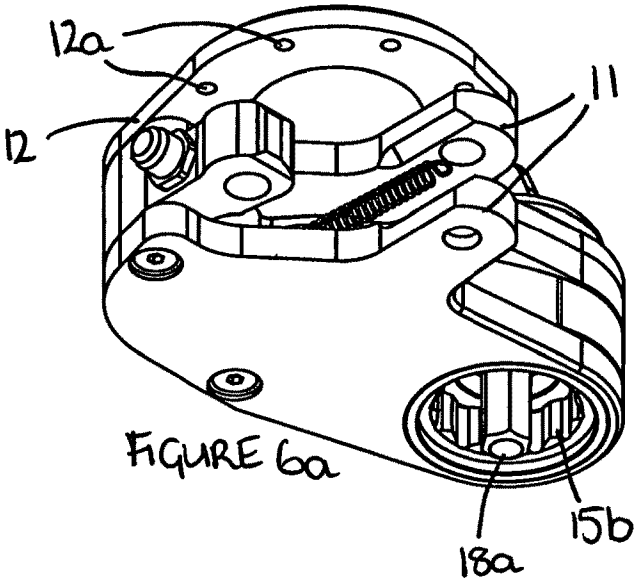
FIG. 6*a* is a schematic representation of a component of the tool illustrated in FIG. 1 view from below.
Figure 6C:
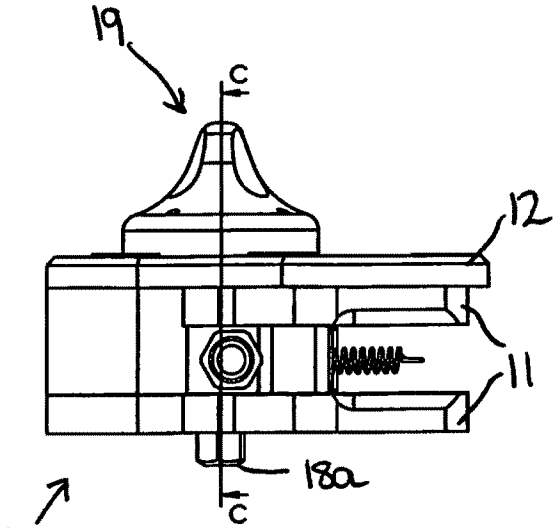
FIG. 6*c* is an end view of the component illustrated in FIGS. 6*a* and 6*b;*
Figure 7B:
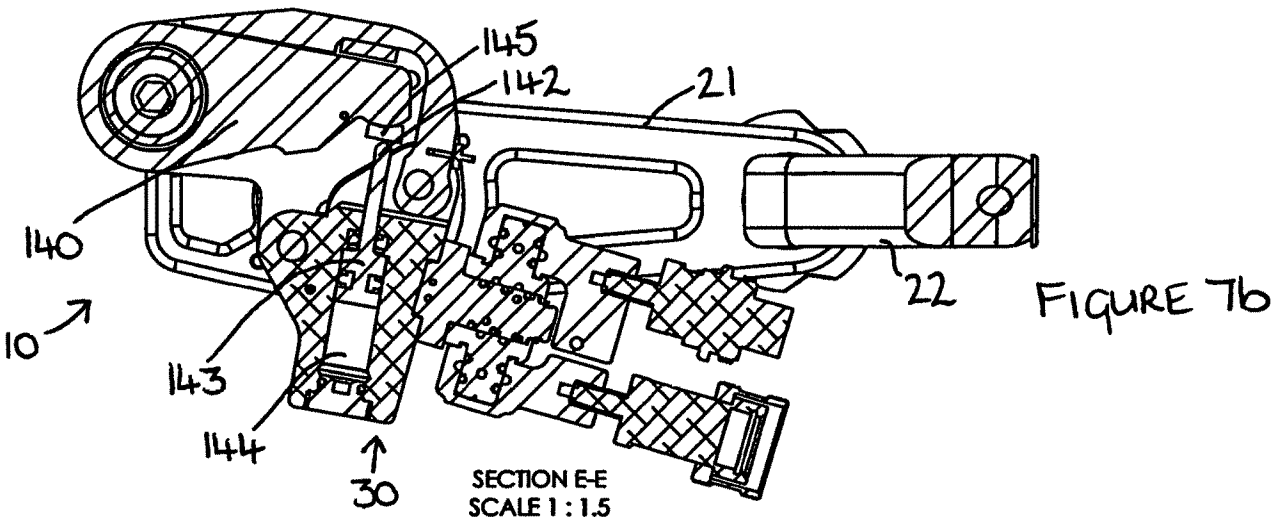
FIG. 7*b* is a section on the axis E-E indicated in FIG. 7*a;*
Figure 7A:
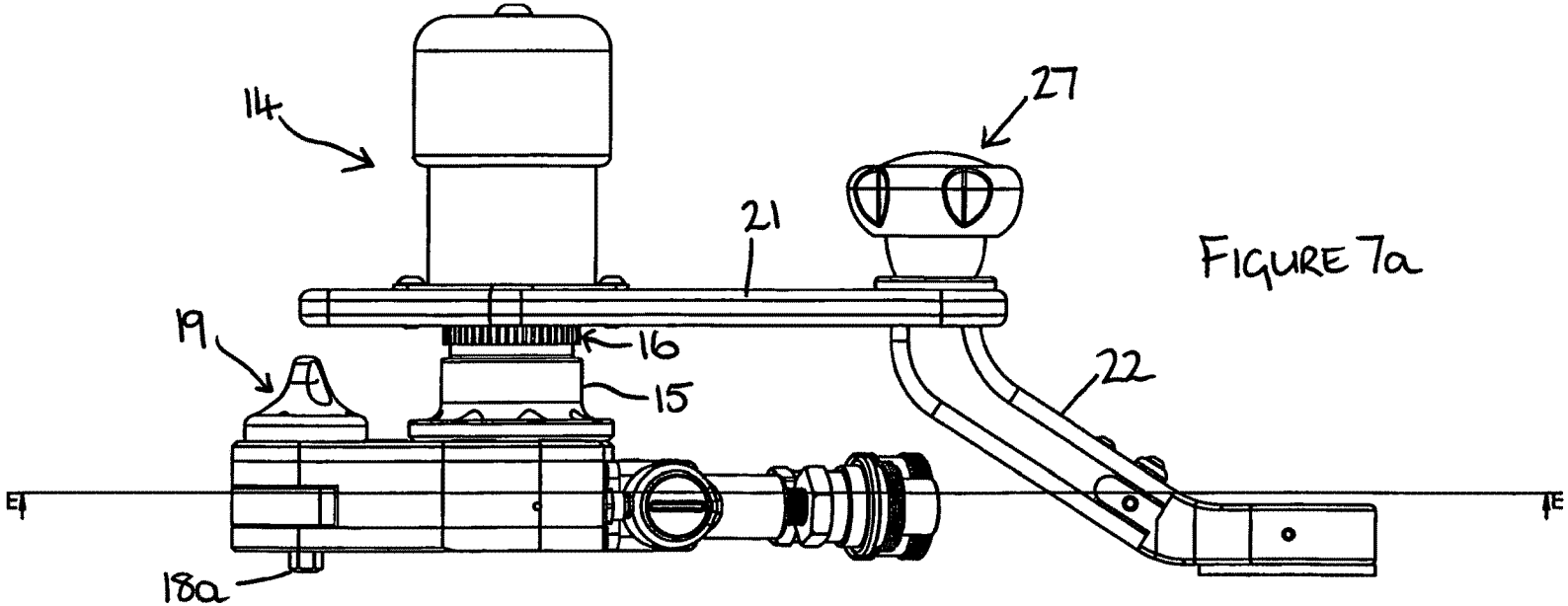
FIG. 7*a* is a side view of the hydraulically actuated tool.

FIG. 4 illustrates in detail the arrangement that prevents rotation of the reaction arm 20 relative to the ratchet link 10. The collar 15 mounts a component 16 that includes external teeth 16*a*. The lever 21 includes an opening 21*a*, the circumference of which is provided with internal teeth that co-operate with the external teeth 16*a* of component 16. The teeth may be formed as splines.

The reaction arm mount 14 allows the force exerted on a work piece by the ratchet link 10 to be reacted through the reaction arm 20, and for the position of the reaction arm 20 to be adjusted relative to the ratchet link 10.

To rotate the reaction arm 20 relative to the ratchet link 10 the lever 21 is moved towards the end cap 14*d* along the axis x-x, compressing the spring 14*e* until the teeth 21*c* of the lever 21 are clear of the teeth 16*a* of the component 16. The reaction arm 20 is then free to rotate about the axis x-x. When the desired position is reached the lever 21 is, if necessary, rotated so the nearest teeth 16*a*, 21*c* are aligned. The lever 21 is then allowed to slide relative to the collar 15 until an equilibrium position is reached, that position being determined by the difference in height between the work piece components to which the ratchet link 10 and the reaction arm 20 are attached.

Figure 2A:
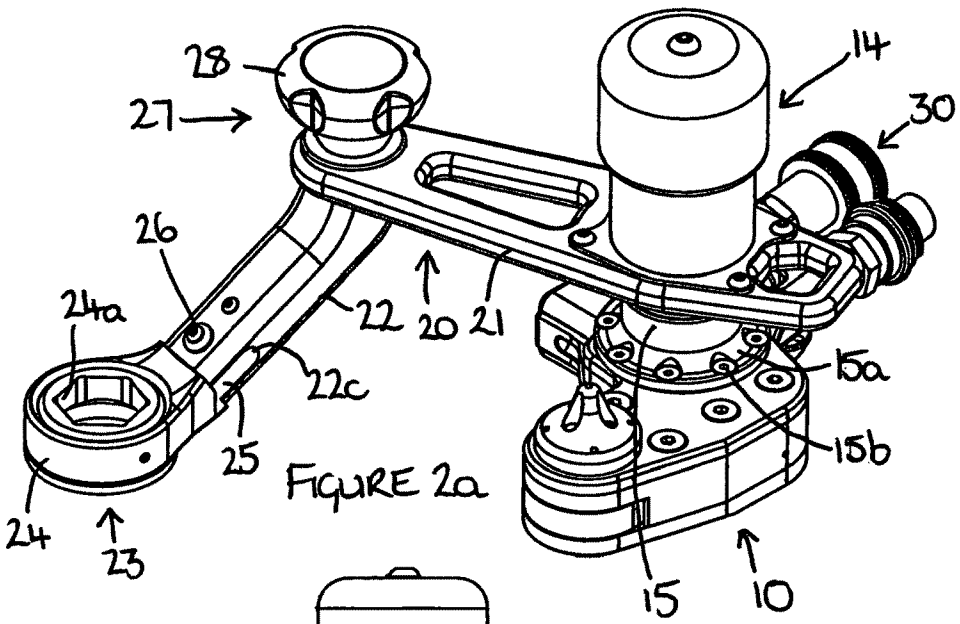
FIG. 2*a* is a schematic representation of the tool illustrated in FIG. 1 with the reaction arm thereof in a first configuration.
Figure 2B:
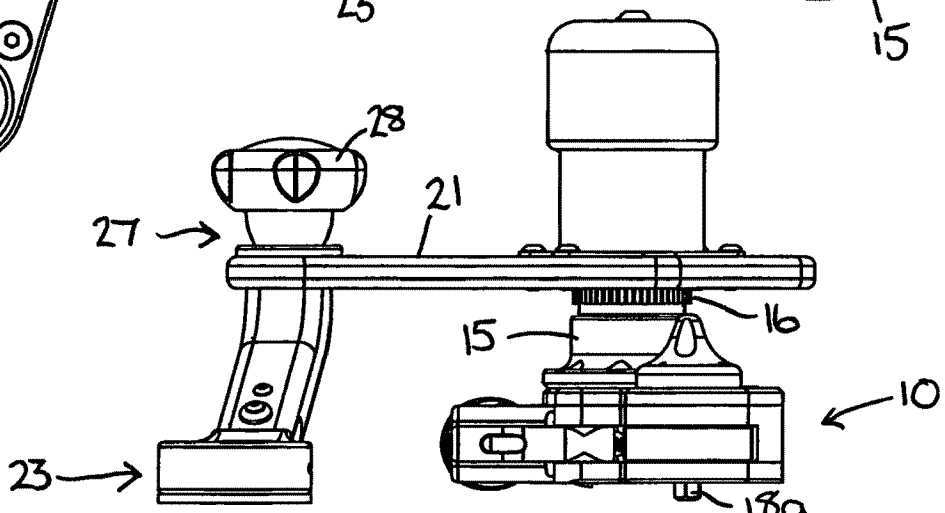
FIG. 2*b* is an end view of the tool illustrated in FIG. 2*a;*
Figure 2C:
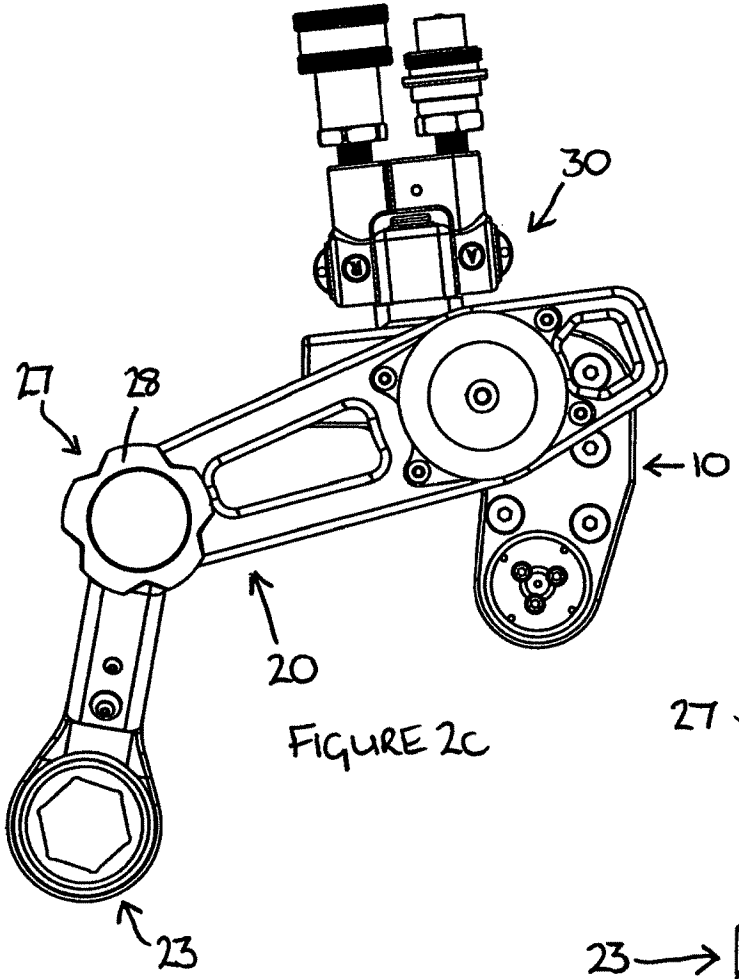
FIG. 2*c* is a plan view of the tool illustrated in FIGS. 2*a* and 2*b;*
Figure 3A:
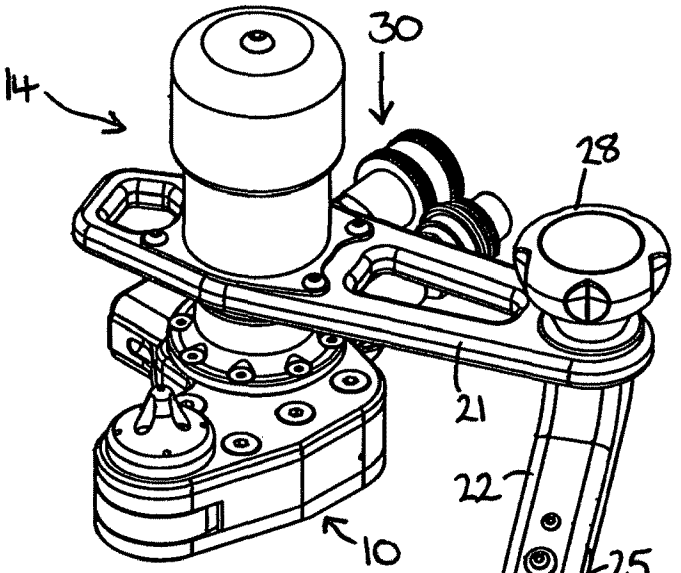
FIG. 3*a* is a schematic representation of the tool illustrated in FIG. 1 with the reaction arm thereof in a second configuration.
Figure 3B:
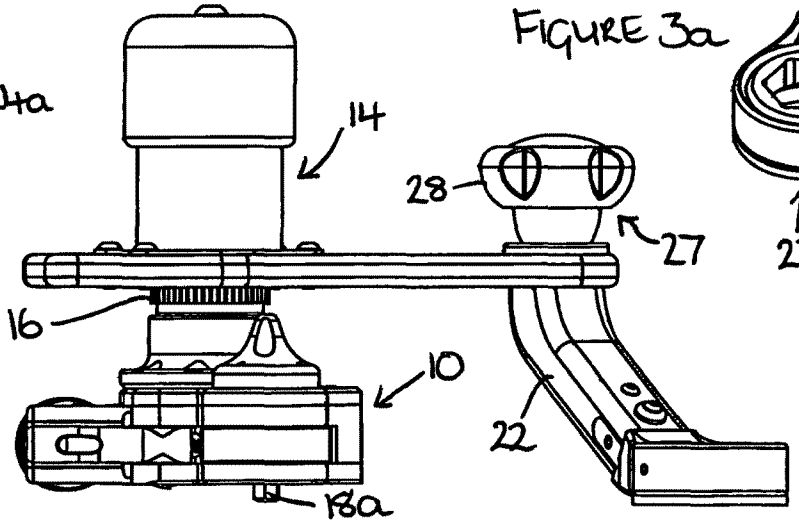
FIG. 3*b* is an end view of the tool illustrated in FIG. 3*a;*
Figure 3C:
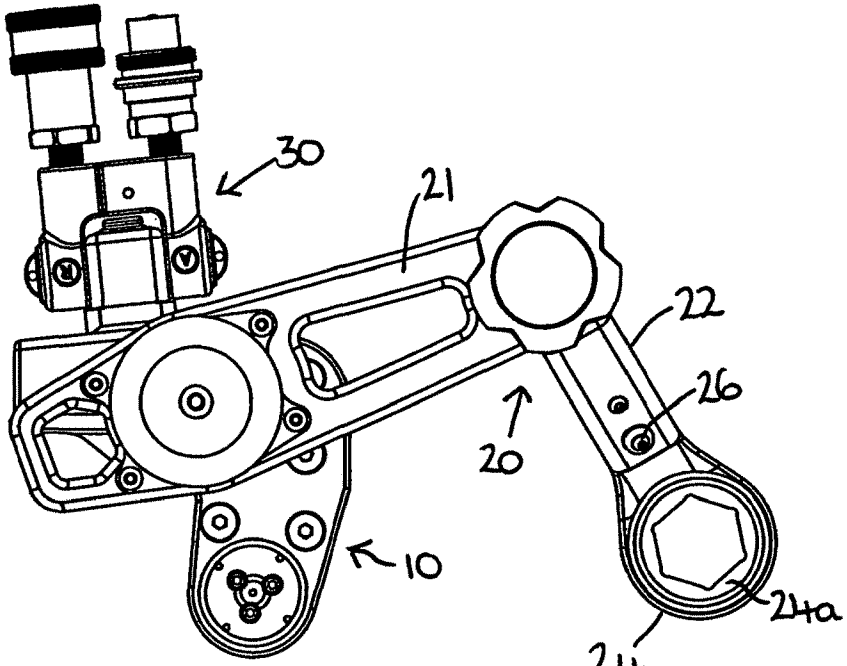
FIG. 3*c* is a plan view of the tool illustrated in FIGS. 3*a* and *b;*

Referring now to FIGS. 2*a* to 2*c* specifically, the reaction arm 20 comprises two levers 21, 22 attached to one another for pivoting therebetween. The levers 21, 22 are connected to one another by a pivot assembly 27 which comprises a hole 21*d* formed in one end of the lever 21, a boss 22*a* formed at the end of lever 22, the boss 22 having an internally threaded bore 28*b* formed therein, a bush 21*e* pressed into the hole 21*d*, the boss 22 received in the hole 21*d*, a knob 28 having an externally threaded screw 29 extending therefrom, and a washer 28*a*.

To set the angle between the levers 21, 22 the knob 28 is turned so that the threaded end of screw 29 and bore 22*b* pull the knob 28 towards the boss 22*a*, compressing the washer 28*a* between the knob 28 and the upper surface of the lever 21 around the hole 21*d*. The bush 21*e* is smaller in diameter than the boss 22*a* and hence prevents the boss from being pulled through the hole 21*d*. The knob 28 is tightened such that sufficient friction between the components of the pivot assembly is generated to take up backlash in the reaction arm 20.

To adjust the angle between the levers 21, 22, the knob 28 is rotated so as to slacken off the components of the pivot assembly such that the lever 22 may be rotated relative to the lever 21. The levers 21, 22 are adjusted to a desired position and the knob 28 is re-tightened.

The lever 22 mounts a reaction spanner head 23, which in the illustrated embodiment is a ring spanner 24*a* mounted in a housing 24. The housing 24 is attached to the lever 22 by a spigot 25 which is received in a corresponding slot 22*c*. A screw 26 fastens the spigot 25 in position in the slot 22*c*. Removing the screw 26 allows the spanner head 23 to be changed for an alternative spanner head.

It is not necessary for the knob 28 to be tightened to transfer the reaction force through the reaction arm because the reaction arm is attached to the ratchet drive and component through which torque is reacted in a non-rotatable manner. However, tightening the knob 28 takes up any backlash in the apparatus.

The ratchet link 10 will now be described in greater detail with reference to FIGS. 4 to 8, The ratchet link 10 comprises a spacer 13 between side plates 11 and a drive plate 140. The drive plate 140 includes a curved nose portion 141 which is acted upon by a piston head 142 which is correspondingly curved so that the two components 141, 142 may slide with respect to one another as the piston 143 reciprocates in cylinder 144 under the influence of pressurised fluid, hydraulic fluid in the present example. In this embodiment the piston 143 is moved in opposing directions in the cylinder by hydraulic fluid pressure, whereas in the embodiment illustrated in FIG. 8 the piston is retuned by a spring 145. The drive plate mounts an externally toothed ratchet socket 150 and drive pawl 16. The ratchet link comprises external teeth 155 which co-operate with teeth 16*a* of the drive pawl 16. When the drive plate 140 is rotated clockwise the teeth of the drive pawl are forced into the teeth 155 of the ratchet link, causing the fastener engaging element 18*a* to rotate. On the reverse stroke of the drive plate, in the anti-clockwise direction, the angle of the teeth 155, 16*a* cause the said teeth to ride over one another. This is facilitated by the manner in which the drive pale 16 is slidably mounted in the drive plate 140, springs 16*c* biasing the drive pawl towards the ratchet socket 150.

Figure 9A:
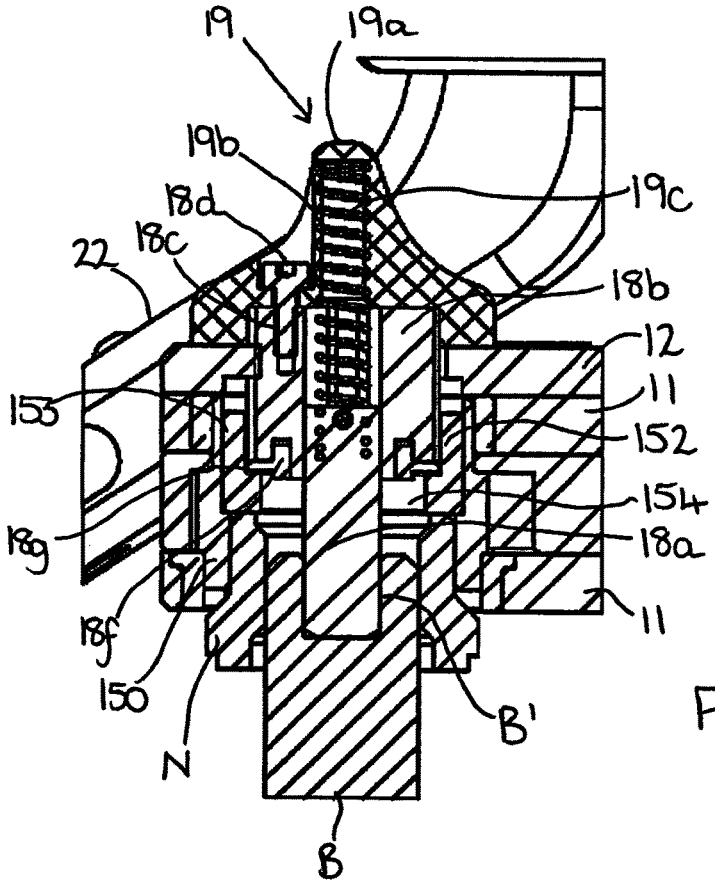
FIGS. 9*a* to 9*c* illustrate a series of representations of a fastener engagement assembly.
Figure 9B:
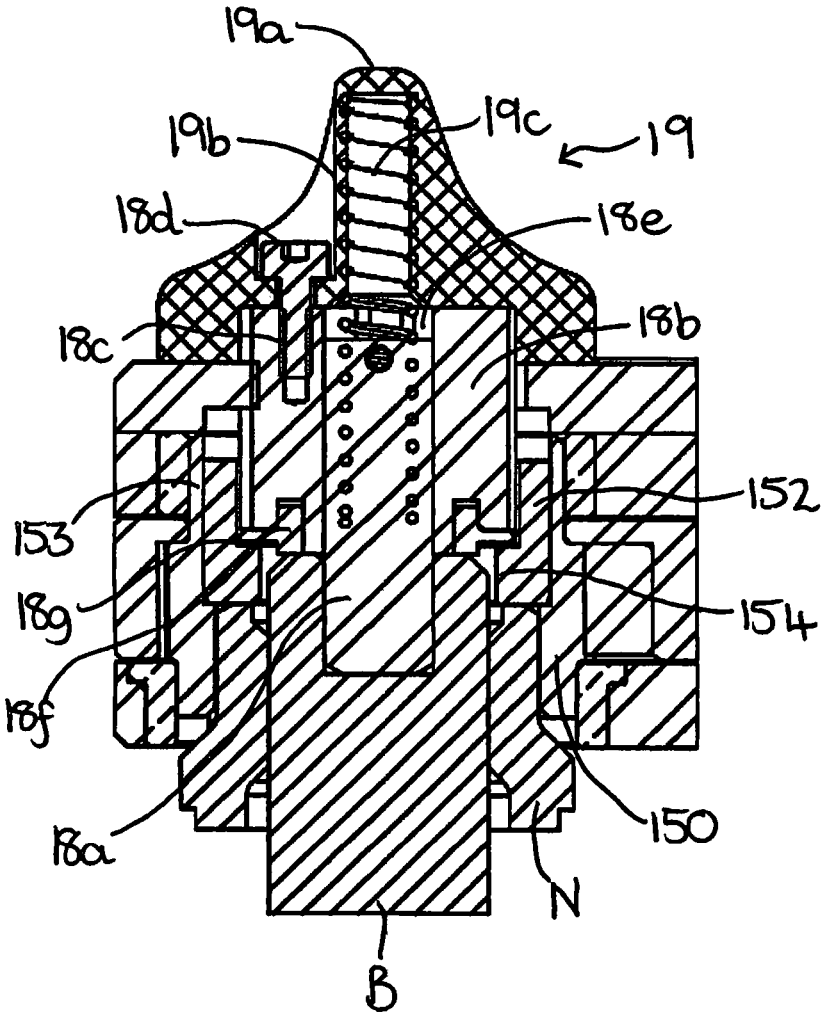
Figure 9C:
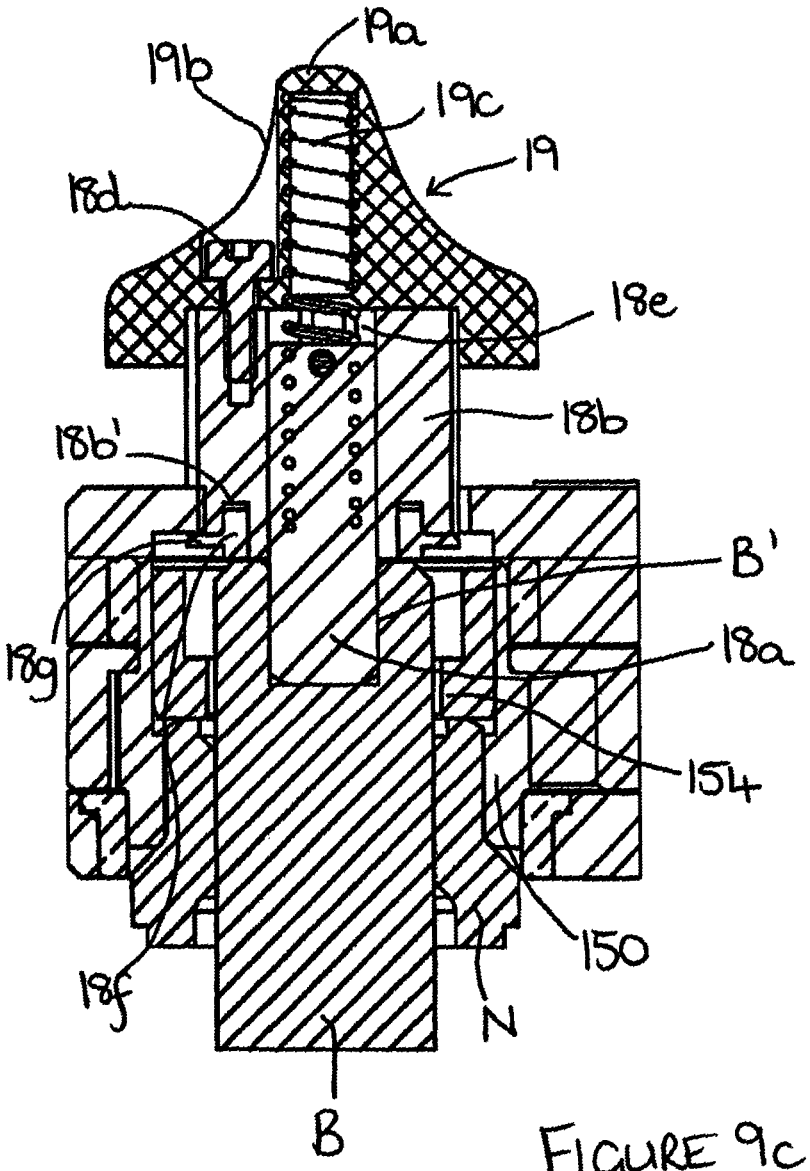
Figure 10:
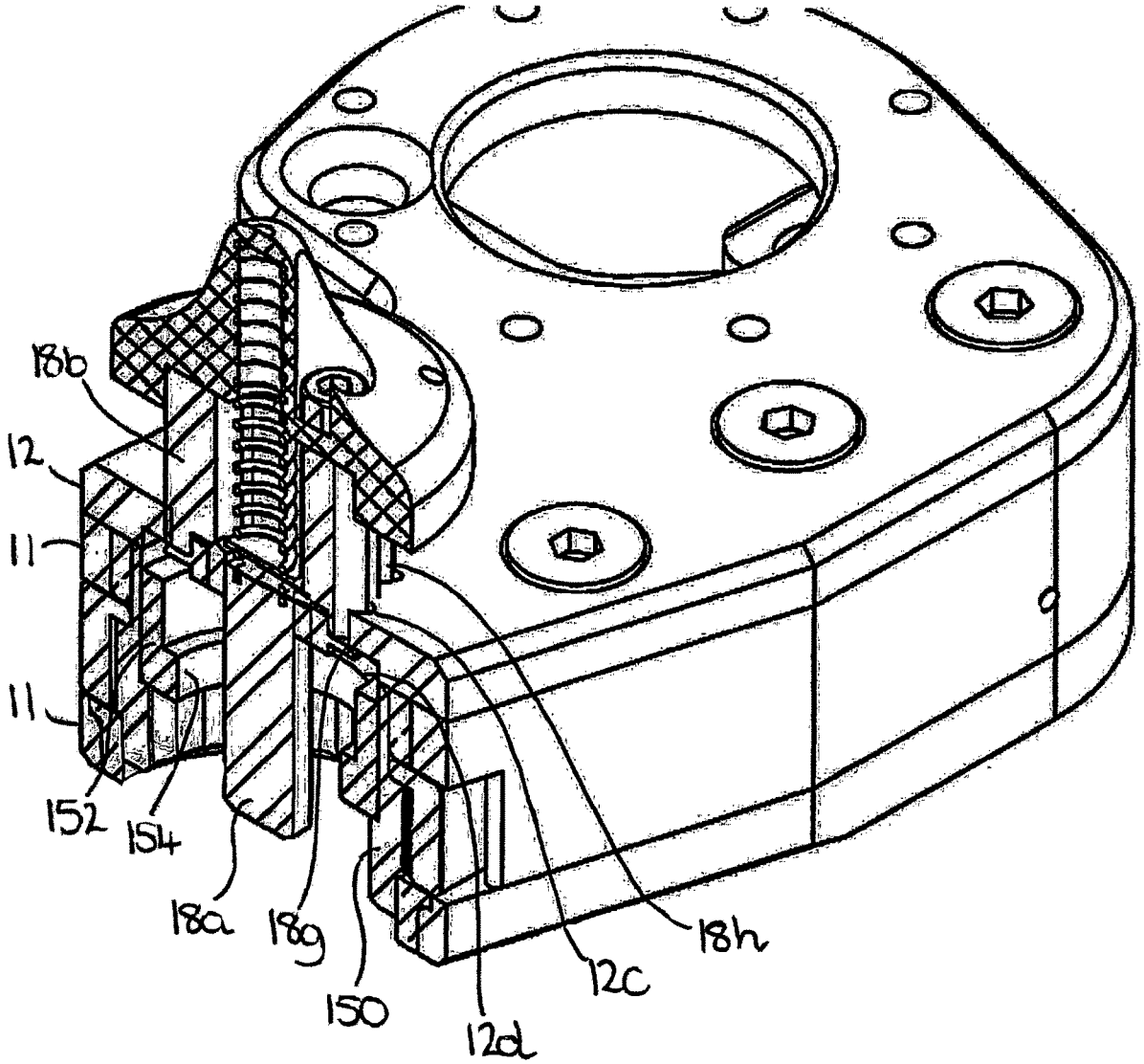
FIG. 10 is a cross-sectional representation of the assembly shown in FIGS. 9*a* to 9*c.
Figure 11:
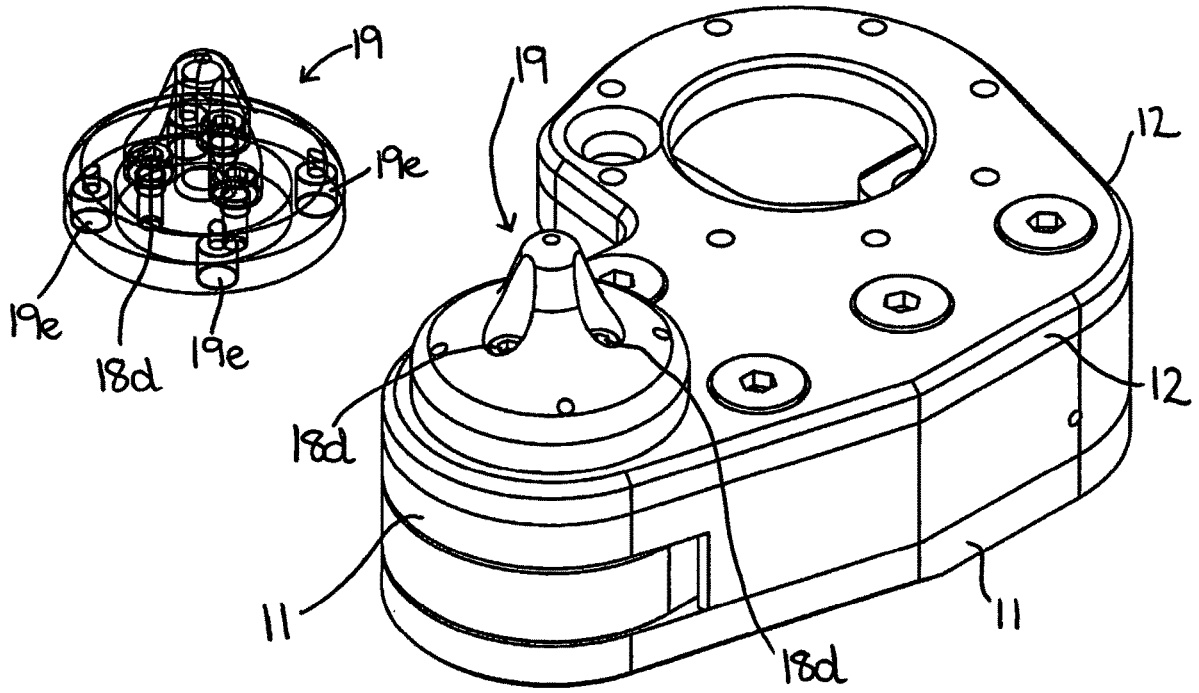
* and FIG. 11 is a schematic representation of the assembly shown in FIGS. 9*a*-9*c* and 10.

Referring also to FIGS. 9*a* to 9*c* in particular, the components of the tool that interact with the fastener in the form of a bolt B and a nut N will be described in greater detail.

In the configuration shown in FIG. 9*a*, the nut N has been rotated so that the threads thereof are engaged with the threads of bolt B. The bolt B includes a recess $B^1$ in the upper part thereof. The recess $B^1$ is hexagonal in the illustrated example. However, other shapes capable of resisting rotation of one part about another may be used. The function of the fastener engaging element 18*a* is to prevent rotation of the bolt B as the nut N is fastened onto said bolt. This is achieved by the manner in which the fastener engaging element 18*a* is mounted on the ratchet link 10.

The ratchet link 10 comprises an assembly that both rotates the nut N relative to the bolt B and also holds the bolt B steady. The inner surface of the ratchet socket 150 is provided with fluted peripheral surface shaped and dimensioned to drivingly engage a hexagonal nut N.

Figure 8:
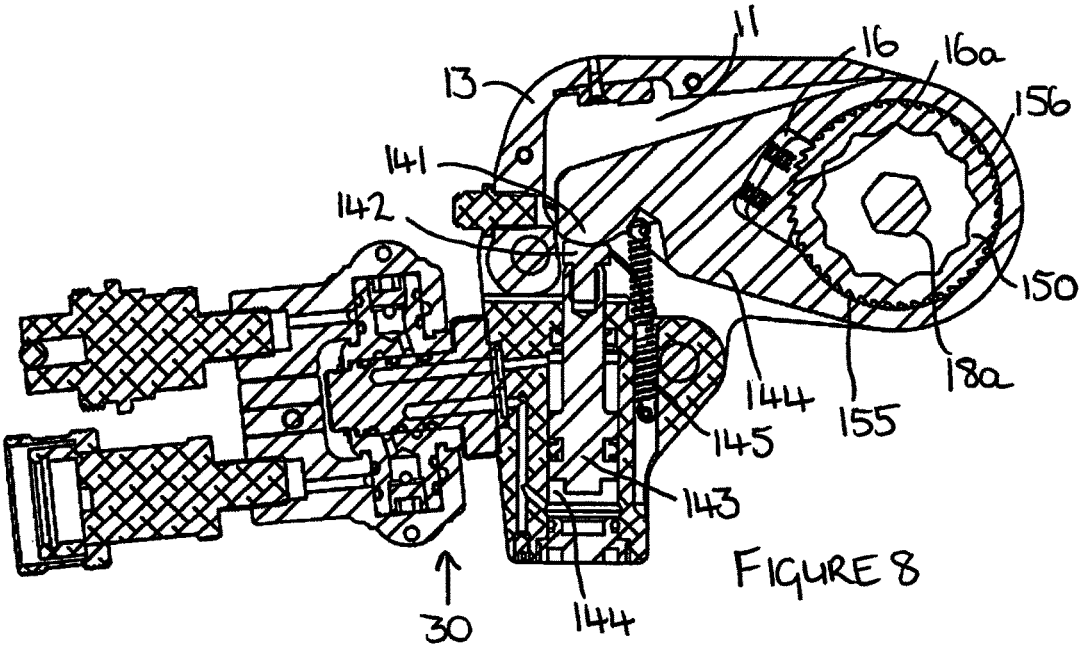
FIG. 8 is a schematic representation of components of a hydraulically actuated tool.

The fluted surface 156 is best shown in FIG. 8.

An upper region 153 of the ratchet socket 150 mounts a collar 152 for rotation therewith. The collar 152 may be a push fit in the upper region 153 of the ratchet socket 150. The collar 152 includes an inwardly extending wall 154. The function of the wall 154 is to support the whole tool with respect to the bolt B when the nut is relatively tight on the bolt as showing FIG. 9*c*. At this point the bolt B passes through the opening surrounded by wall 154. It is in this configuration that maximum torque is applied to the nut and bolt. Providing a support in the tool that engages the bolt B steadies the tool on the nut/bolt as torque is applied.

A fastener engaging element 18*a* is mounted slidably in a mounting assembly which comprises a sleeve 18*b* having an opening 18*e* therein in which the fastener engaging element 18*a* is slidably mounted. In the present example the fastener engaging element 18*a* is hexagonal and the opening 18*e* is also hexagonal so that relative rotation between the sleeve 18*b* and the fastener engaging element 18*a* is not possible.

The sleeve 18*b* is mounted so that it may slide in its axial direction with respect to the ratchet link 10. In particular, the cover plate 12 includes an internally splined opening 12*c*. The inner peripheral surface of the opening 12*c* is provided with spines 12. The outer surface of the sleeve 18*b* is provided with splines 18*h* which are configured to mate with the splines 12*c*, thereby permitting movement of the sleeve 18*b* in the axial direction thereof, whilst preventing rotation of the sleeve 18*b* relative to the ratchet link 10.

A retainer clip 18*f* is attached to the underside of the sleeve 18*b* in the clip retaining portion 18*b*'. The peripheral edge 18*g* of the clip 18*f* protrudes radially beyond the edge of the sleeve 18*b* and is aligned with a recess 12*d* in the underside of the cover plate 12 adjacent the opening 12*c*. The retainer clip 18*f* limits the movement of the sleeve 18*b* relative to the ratchet link 10.

The sleeve 18*b* is attached to a cap 19 by means of a screw 18*d* which engages with a threaded hole 18*c*, the head of the screw 18*d* sitting in a recess 19*d* in the cap 19. Hence, the cap and the sleeve 18*b* are fast with one another for both rotation and axial movement with respect to one another.

Referring also to FIG. 9*b*, as the nut N has been rotated such that the upper face of tool B is proximate the collar 154 and engages with the underside of the sleeve 18*b*. Further, the spring 19*c* is fully compressed, the spring 19*c* being located predominantly in bore 19*b* of the cap 19. The bore 19*b* is closed at end 19*a*.

Further rotation of the nut N causes the end of the bolt B to push the sleeve 18*b* upward moving the sleeve 18*b* axially through the opening 12*c* in the cover plate 12 As discussed above, the extent of movement of the sleeve 18*b* is constrained by the interference of retainer clip 18*f* and recess 12*d* of the cover plate 12.

The cap 19 is provided with four magnets 19*e*. These magnets secure the cap 19 to the cover plate in the absence of a force sufficient to overcome the force attracting the magnets 19*e* to the cover plate 12. When the ratchet link is removed from the nut N and bolt B the spring 19*c* moves the fastener engagement element 18*a* is moved away from the cap 19 and the magnets 19*e* are attracted back into contact with the surface of the cover plate 12.

Operation of the tool is as follows:

1) the nut N is placed on the bolt B and the threads thereof engaged manually;
2) the socket 150 of the ratchet link is presented up to and mounted on the bolt B;
3) the lever arm 20 is raised against the spring force 14*e* so that the splines 16*a* and engaging teeth of the lever 21 are clear of one another and the lever arm rotated about the sleeve until the spanner head is aligned with a nut to which the spanner head may be attached;
4) the closest corresponding splines and teeth are aligned and the lever 20 slides along the splines 16*a;*
5) the spanner head is attached to the nut with which it is aligned;
6) the knob 28 is tightened;
7) hydraulic fluid is caused to pass through the power head 30 causing the socket 150 to rotate, tightening or slackening the nut N front the bolt B.

The tool of the invention allows a reaction arm to be attached to an object that lies in a different plane to that of the fastener to which torque is to be applied. Furthermore, the manner in which the reaction arm mounting assembly allows for the reaction arm to be set to a desired angular position relative to the fastener to which torque is to be applied and a component through which the reaction force is to be reacted.

The fastener engagement member provides for torque to be applied to one part of a threaded fastener, for example a nut of a nut and bolt, whilst at the same time preventing a bolt to which the nut is being attached from rotating.

Furthermore, the assembly providing the fastener engagement member may provide a support for the tool during the period where maximum torque is applied to a fastener. The assembly allows the end of a bolt to pass into the ratchet drive as a nut is run down a bolt and a support is provided to engage with the side of the bolt as increasing levels of torque are applied. At the point where maximum torque is applied the ratchet drive may vibrate. Providing a means to support the ratchet drive during such vibration is a significant improvement since unchecked such vibration may result in a ratchet drive coming free from the component being tightened.

The invention claimed is:

1. A power tool including a ratchet drive, the power tool comprising:

a ratchet driven socket mounted for rotation within a ratchet drive housing;

a fastener engagement member configured to resist rotation of a fastener engaged therewith;

a mount for the fastener engagement member, the ratchet drive socket, the fastener engagement member and the mount being co-axial with each other, the fastener engagement member slidably mounted in the mount, wherein a shape and configuration of the mount and the fastener engagement member prevents relative rotation therebetween;

an opening extending through the ratchet drive housing, the mount being slidably mounted in the opening and slidable through the opening to be positioned externally of the ratchet drive housing, wherein the shape and the configuration of the mount and the opening prevents relative rotation therebetween;

biasing means arranged to exert a force urging the fastener engagement member along a common axis in a direction away from the opening in the ratchet drive housing; and a motion restrictor associated with the mount and limiting an extent of sliding motion of said mount through the opening.

2. The power tool according to claim 1, wherein the motion restrictor includes a first element attached to the mount and at least one second element situated in a path of the mount.

3. The power tool according to claim 2, wherein one of the at least one second elements comprises a collar mounted on the ratchet drive socket and including a portion extending into a path of the first element.

4. The power tool according to claim 2, wherein one of the at least one second elements comprises part of the ratchet drive housing proximate the opening, the first element extending radially beyond an edge of the opening.

5. The power tool according to claim 1, further comprising a fastener support member including an inner peripheral edge, the fastener support member so shaped and dimensioned as to permit passage of a fastener therethrough and wherein in use, with a fastener extending through the fastener support member, the inner peripheral edge and an outer surface of the fastener engage with each other upon operation of the power tool.

6. The power tool according to claim 1, further comprising a cap attached to the mount and situated to an outer side of the ratchet drive housing, wherein one end of the biasing means is housed in the cap and wherein the cap is provided with means to urge the cap towards the ratchet drive housing.

7. The power tool according to claim 6, wherein the means to urge the cap towards the ratchet drive housing is a magnetic means.

8. The power tool according to claim 7, wherein the magnetic means comprises a plurality of spaced apart magnets mounted in the cap.

9. A reaction arm mounting assembly comprising a first part and a second part, wherein the first part is configured for attachment to a power tool and the second part is mounted on the first part, and wherein the mounting of the second part on the first part: permits sliding motion between the first and second parts along an axis common to the first and second parts in a first sliding region and prevents rotation between the first and second parts in the first sliding region; and permits rotation between the first and second parts in a second sliding region, and further comprising biasing means configured to exert a biasing force on the first and second parts in a first direction, the biasing force urging the first and second parts to be in the first sliding region, and the biasing force being overcome to move the first and second parts in a second direction opposite the first direction to situate the first and second parts in the second sliding region.

10. The reaction arm mounting assembly according to claim 9, wherein the first and second parts of the assembly include co-operating protrusions and indents respectively and wherein the first sliding region is provided by the co-operating protrusions and indents.

11. The reaction arm mounting assembly according to claim 10, wherein the co-operating protrusions and indents are provided by a plurality of co-operating splines on each of the first and second parts.

12. The reaction arm mounting assembly according to claim 9, wherein in the second sliding region one of the first and second parts is free of indents or protrusions that co-operate with protrusions or indents of another of the first and second parts.

13. The reaction arm mounting assembly according to claim 12, wherein the first part of the reaction arm mounting assembly is free of indents or protrusions in the second sliding region.

14. The reaction arm mounting assembly according to claim 9, wherein one of the first and second parts is mounted about another of the first and second parts.

15. The reaction arm mounting assembly according to claim 9, wherein the assembly includes a biasing means support comprising first and second biasing means support components, wherein the first biasing means support component is attached to the first part and the second biasing means support component is attached to the second part.

16. The reaction arm mounting assembly according to claim 15, wherein a part of the first biasing means support component is surrounded by the biasing means.

17. The reaction arm mounting assembly according to claim 15, wherein the biasing means is situated inwardly of the second biasing means support component.

18. The reaction arm mounting assembly according to claim 15, wherein the first biasing means support component comprises a biasing means enclosure member, which surrounds the biasing means and which is arranged to permit sliding and rotation relative to the second biasing means support component.

19. The reaction arm mounting assembly according to claim 9, wherein the second part forms a part of or is attachable to a reaction arm.

20. A power tool having attached thereto a reaction arm mounting assembly comprising a first part and a second part, wherein the first part is configured for attachment to a power tool and a second part is mounted on the first part, and wherein the mounting of the second part on the first part: permits sliding motion between the first and second parts along an axis common to the first and second parts in a first sliding region and prevents rotation between the first and second parts in the first sliding region; and permits rotation between the first and second parts in a second sliding region, and further comprising biasing means configured to exert a biasing force on the first and second parts in a first direction, the biasing force urging the first and second parts to be in the first sliding region, and the biasing force being overcome to move the first and second parts in a second direction opposite the first direction to situate the first and second parts in the second sliding region.

21. The power tool according to claim 20, further comprising a reaction arm.

22. The power tool according to claim 21, wherein the reaction arm includes two parts connected together by a lockable pivot assembly.

23. The power tool according to claim 21, wherein the reaction arm mounts a socket head.

24. The power tool according to claim 23, wherein the reaction arm is adapted for removable attachment of a socket head.

25. The power tool according to claim 24, comprising a set of different socket heads.

26. The power tool according to claim 20, wherein the power tool includes a ratchet drive, the power tool comprising:

a ratchet driven socket mounted for rotation within a ratchet drive housing;

a fastener engagement member configured to resist rotation of a fastener engaged therewith;

a mount for the fastener engagement member, the ratchet drive socket, the fastener engagement member and the mount co-axial with each other, the fastener engagement member slidably mounted in the mount, wherein the shape and configuration of the mount and the fastener engagement member prevent relative rotation therebetween;

an opening in the ratchet drive housing, the mount slidably mounted in the opening, wherein the shape and configuration of the mount and the opening prevent relative rotation therebetween;

biasing means arranged to exert a force urging the fastener engagement member along the common axis in a direction away from the opening in the ratchet drive housing; and a motion restrictor associated with the mount and limiting the extent of sliding motion of said mount through the opening.

* * * * *